US005785189A

United States Patent [19]

Gollob et al.

[11] Patent Number: 5,785,189

[45] Date of Patent: Jul. 28, 1998

[54] DISPLAY SHELF DEVICE HAVING A RIGID STRUCTURE

[75] Inventors: Edward N. Gollob; James David Robertson, both of Atlanta, Ga.

[73] Assignee: The Mead Corporation, Dayton, Ohio

[21] Appl. No.: 791,881

[22] Filed: Jan. 31, 1997

[51] Int. Cl.[6] ..... A47F 5/00

[52] U.S. Cl. ..... 211/187; 211/74; 211/106; 211/94.02; 211/181.1; 108/109

[58] Field of Search ..... 211/74, 106, 181.1, 211/187, 186, 94.5; 108/102, 143, 109, 193, 180, 181

[56] References Cited

U.S. PATENT DOCUMENTS

| | | | |
|---|---|---|---|
| 985,924 | 3/1911 | Nelson | 108/109 |
| 3,079,206 | 2/1963 | Glezen | 108/109 X |
| 4,469,231 | 9/1984 | Hehn | 108/180 X |
| 5,454,331 | 10/1995 | Green | 108/193 X |
| 5,595,127 | 1/1997 | Eustace et al. | 108/109 |

*Primary Examiner*—Robert W. Gibson, Jr.
*Attorney, Agent, or Firm*—Tsugihiko Suzuki

[57] ABSTRACT

A display shelf device comprises a pair of opposing side walls and a shelf mounted on the side walls. The mutually facing inner upright surfaces of the side walls are formed respectively with a pair of substantially horizontal grooves. Each groove has a first section adjacent to the respective upright surface and a second section remote from the respective upright surface. Each groove has a vertical size greater at the second section than at the first section. The shelf is provided at its opposite side edges with mounting means. The mounting means are received in the grooves such that the side walls are interconnected by the shelf. The mounting means include locking means received in the second sections of the grooves to lock the mounting means in the grooves. The locking means have a vertical size greater than the vertical size of each groove at the first section.

17 Claims, 6 Drawing Sheets

DISPLAY SHELF DEVICE HAVING A RIGID STRUCTURE

BACKGROUND OF THE INVENTION

The present invention relates generally to merchandising devices, and more particularly, to those display devices having shelves inserted at their side edges into grooves formed in the shelf-supporting side walls.

Display shelf devices with shelf-receiving grooves are known in the merchandising of lightweight articles such as clothes. An example of such a device is disclosed in U.S. Pat. No. 4,596,195 to Wenger. The disclosed device has a pair of opposing upright side walls formed with pairs of horizontal grooves arranged in vertical rows. A display shelf may be inserted at its opposite side edges into whichever pair of grooves so that it is mounted on the side walls at a desired elevation. Such mounting of the shelf is achieved without any fasteners or brackets, which is particularly convenient in the situations where rearrangement or relocation of the shelves is periodically required to merchandise different articles.

While such conventional shelf devices have experienced considerable success, they are not adequate to display all kind of articles. For example, when loaded with large-sized soft drink bottles such as two-liter bottles, the shelves tends to be warped downwardly. This may results in accidental disengagement of the shelves from the side walls.

What is needed, therefore, is a display shelf device having shelf-receiving grooves, which performs improved load resistance without detracting from its convenience in mounting shelves onto the shelf-supporting side walls.

SUMMARY OF THE INVENTION

In the present invention, locking means are provided at the opposite side edges of a shelf. Such locking means cooperate with a pair of uniquely shaped grooves in the side walls to secure the shelf to the side walls as well as to facilitate mounting of the shelf.

According to the invention, a display shelf device comprises a pair of opposing side walls and a shelf mounted on the side walls. The inner upright surfaces of the side walls are formed with a pair of substantially horizontal grooves, respectively. Each groove has a first section adjacent to the respective upright surface and a second section remote from the respective upright surface. Each groove has a vertical size greater at the second section than at the first section. The shelf is provided at its opposite side edges with mounting means. The mounting means are received in the grooves such that the side walls are interconnected by the shelf. The mounting means include locking means received in the second sections of the grooves to lock the mounting means in the grooves. The locking means have a vertical size greater than the vertical size of each groove at the first section. In this arrangement, the shelf functions as a brace between the side walls in the sense that side walls are secured together by the shelf. Thus, the arrangement provide the device with improved rigidity. This is particularly true when the invention is used with a top cross member and/or a bottom cross member for interconnecting the side walls.

In a preferred embodiment, each groove has a main length including the first and second sections. The main length of each groove extends rearward from the front end of the respective side wall so that the shelf may be inserted into the grooves from the front ends of the side walls. To facilitate manufacturing of the side walls, the main length of each groove may be extended only partially across the respective side wall to an intermediate position spaced from the rear end of the respective side wall. However, each groove may also have an auxiliary length extending from the intermediate position to the rear end of the respective side wall. The depth of each groove at the auxiliary length may be equal to the depth of that groove at the main length while the vertical size of each groove at the auxiliary length may be constant at any position along the depth of the groove. The length of the shelf along its side edges may be greater than the main length of each groove, in which case the rear edge of the shelf may be supported by suitable means such as a back wall or the auxiliary lengths of the grooves.

In another preferred embodiment, each groove has a cross section of a configuration selected from the group including a L-shape, a T-shape, a wedge-shape, a circle or the like.

In still another preferred embodiment, the mounting means comprises the side edges of the shelf, and the locking means comprises ribs formed along the side edges, respectively. Alternatively, the locking means comprises one or more protrusions formed along each side edge. Otherwise, the mounting means comprises a pair of mounting hooks secured respectively to the side edges of the shelf, and the locking means comprises the distal portions of the mounting hooks joined to their proximal portions extending laterally from the side edges.

In a further preferred embodiment, the side walls are two separate members secured together by the shelf. In this embodiment, a pair of back walls may be connected respectively to the side walls to form a pair of shelf-supporting structures each having a L-shaped horizontal cross section. The back walls may be formed with a pair of collinear horizontal grooves for receiving the rear edge of the shelf.

The objects and advantages of the present invention will be apparent from the following description, the accompanying drawings and the appended claims.

DETAILED DESCRIPTION OF THE PREFERRED EMBODIMENTS

Figure 1:
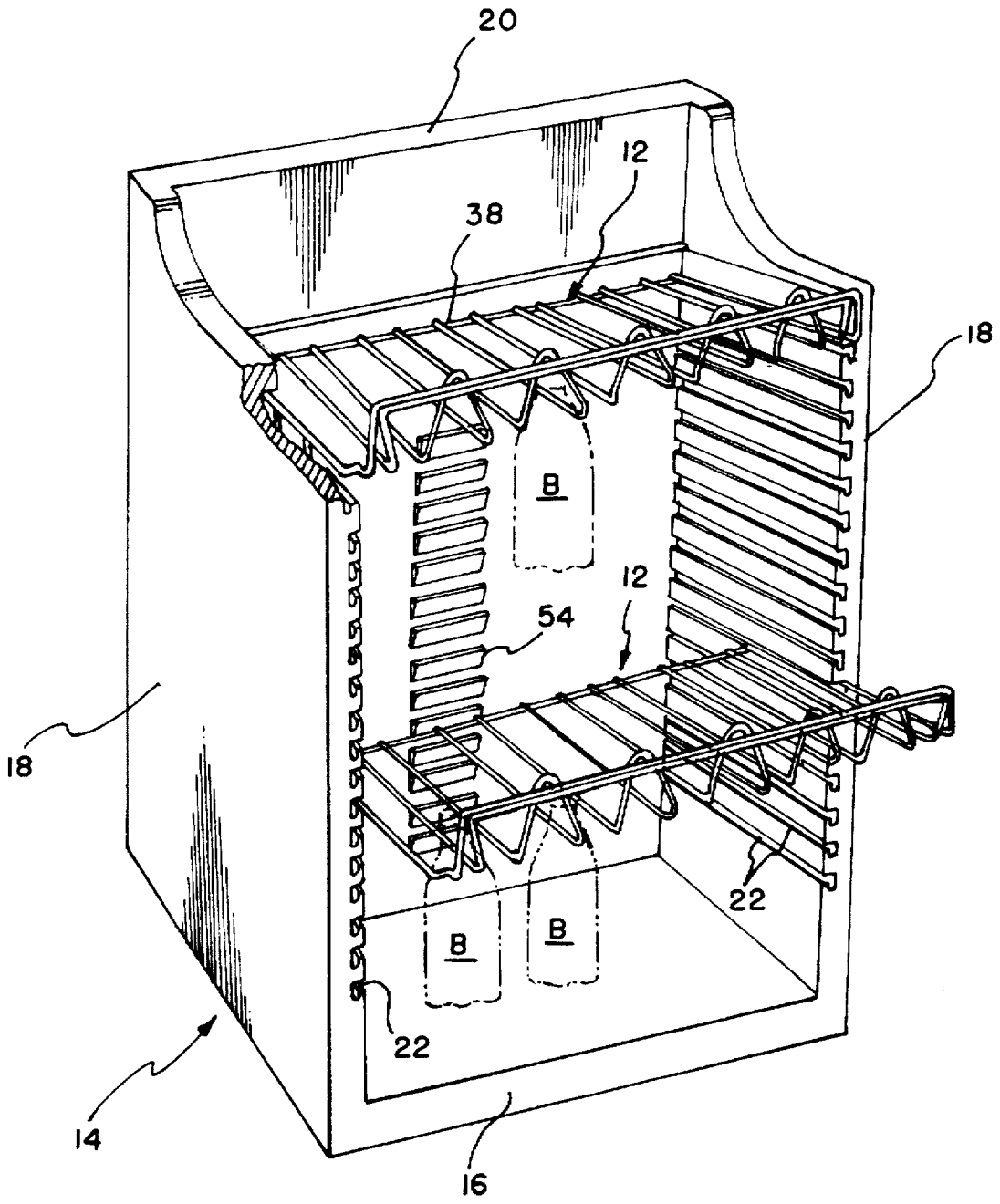
FIG. 1 is a perspective view of a display shelf device according to the present invention.

FIG. 1 illustrates a display shelf device according to the invention. The illustrated device is designed for displaying bottles. The device includes a plurality of wire shelves 12 and a shelf-supporting structure 14 on which the shelves 12 are mounted in a tiered relationship. The device may have only one shelf 12. However, it will in general have two or more shelves 12 as shown in FIG. 1.

The supporting structure 14 may be formed of plastic, sheet metal or wood, and preferably of plastic. A preferred form of a plastic supporting structure is a unitary, hollow body of a rotation- or blow-molded construction. The structure 14 comprises a base 16, a pair of opposing side walls 18 upstanding from the base 16, and a back wall 20 interconnecting the rear ends of the side walls 18. The inner upright surfaces of the side walls 18 are facing each other and are formed with pairs of horizontal grooves 22 extending entirely across the side walls 18. The grooves 22 in each side wall 18 are vertically arranged at equal spacings while the grooves 22 of each pair are positioned at the same elevation.

Figure 2:
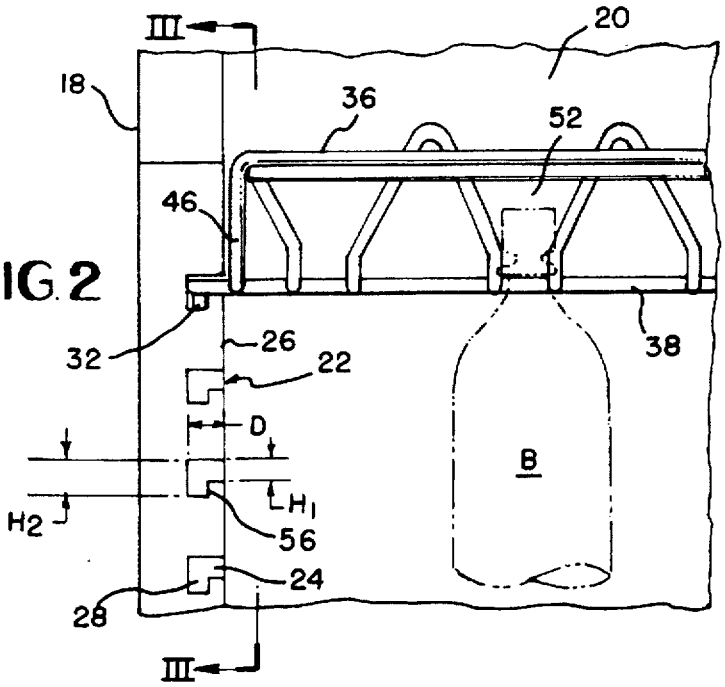
FIG. 2 is a fragmentary front view of the display shelf device in FIG. 1.
Figure 3:
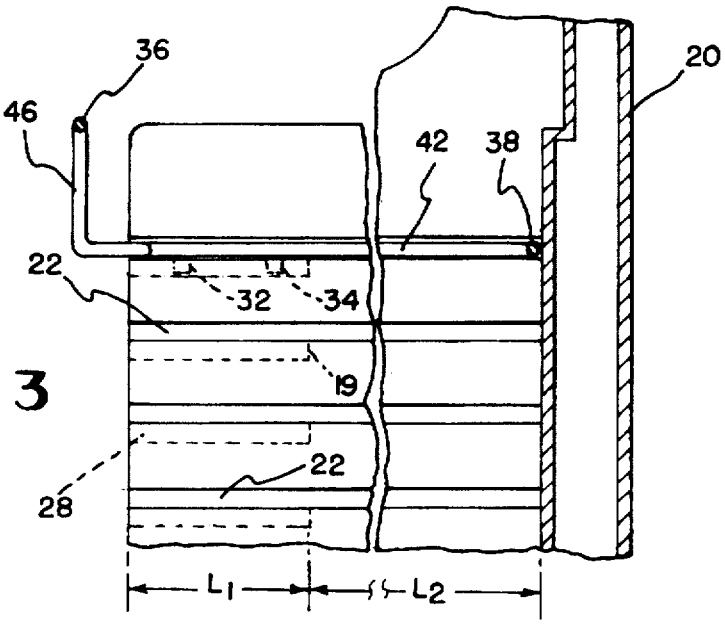
FIG. 3 is a fragmentary view taken along the line III—III in FIG. 2.

Each groove 22 includes two continuous and collinear lengths, i.e., a main length L1 and an auxiliary length L2, which are best shown in FIG. 3. The main length L1 of each groove 22 extends from the front end of the associated side wall 18 to a position 19 intermediate the front and rear ends of the side wall 18. The cross section of each groove 22 at the main length L1 is L-shaped as best shown in FIG. 2. As illustrated in FIG. 2, the main length L1 of each groove 22 includes a first/narrower section 24 adjacent to the inner surface 26 of the respective side wall 18 and a second/wider section 28 remote from the inner surface 26. The vertical size H1 of the first section 24 is substantially smaller than the vertical size H2 of the second section 28.

The auxiliary length L2 of each groove 22 extends from the intermediate position 19 to the rear end of the respective side wall 18. The depth of each groove 22 at the auxiliary length L2 may be equal to the depth D of that groove 22 at the main length L1; however, the cross section of each groove 22 at the auxiliary length L2 is rectangular or U-shaped. More specifically, the vertical size of each groove 22 at the auxiliary length L2 is substantially constant and equal to the vertical size H1 of the first section 24 of that groove 22 at the main length L1.

Alternative arrangement may be used in the invention wherein each groove is formed without the auxiliary length and has only the main length extending either entirely or partially across the respective side wall. In any arrangement, it is preferred to design the main length less than six (6) inches, and more preferably about four (4) inches, to facilitate molding of the supporting structure.

Further details of the general construction of the supporting structure 14 is described in U.S. Pat. No. 5,394,997 which is hereby incorporated by reference.

Figure 4:
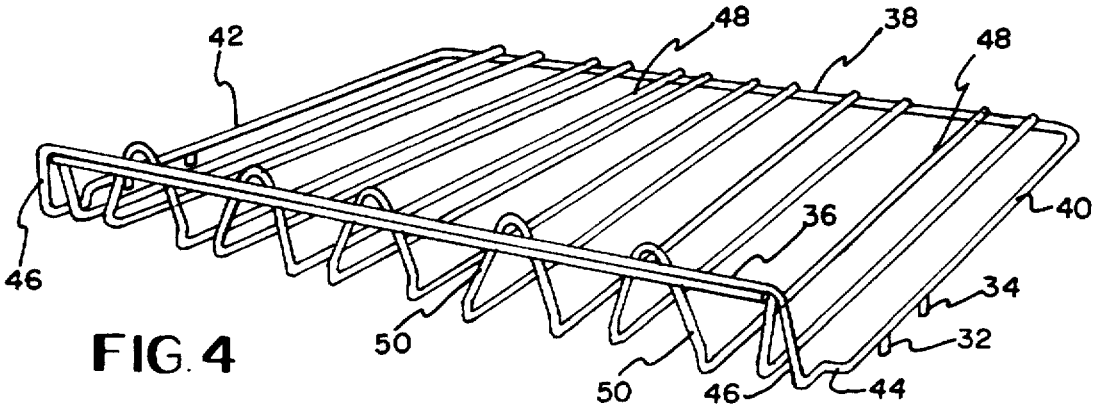
FIG. 4 is an enlarged perspective view of one of the shelves in FIG. 1.

The shelves 12 are suspension-type bottle dispensing racks formed of wire. As shown in FIG. 4, each shelf 12 comprises a pair of front and rear opposed transverse members 36 and 38 interconnected by a pair of side members 40 and 42. These members 36, 38, 40 and 42 are preferably formed from a single continuous strip of wire. Each side member is cranked at the portion 44 to locate the majority of its horizontal length at the position outwardly offset from the respective upturned portion 46. The offset lengths of the side members 40 and 42 provide mounting means to be received in the associated grooves 22 of the support structure 14 so that the respective shelf 12 is mounted at a desired elevation. Locking means in the form of a pair of protrusions 32 and 34 are formed on the lower surface of each of the side members 40 and 42 at the positions close to the respective cranked portion 44. These protrusions 32 and 34 are formed of pieces of wire welded to the side members 40 and 42. The total vertical size of each protrusion and the associated side member is greater than the vertical size H1 of the first section 24 of each groove 22. This arrangement is effective to prevent the side members 40 and 42 from being dislodged laterally from the associated grooves 22. Preferably, the distance between the rear protrusion 34 and the adjacent cranked portion 44 is less than six inches and more preferably about four inches.

Spaced parallel longitudinal members 48 are extended between the front and rear members 36 and 38. The rear ends of the longitudinal members 48 are welded to the rear member 38 while the forward end portions 50 of the longitudinal members 48 are bent upward at an angle and welded to the front member 36. Adjacent ones of the longitudinal members 48 are spaced alternately relatively closely together and relatively widely apart. The longitudinal members 48 of each more closely spaced pair serve as rails for receiving therebetween the necks of flanged bottles. Referring to FIGS. 1 and 2, flanged bottles "B", when received between the closely spaced pair of members 48, are slidably engaged at the undersides of their neck flanges with the members 48 and thereby are suspended from the respective shelf 12 for sliding movement along the members 48. The upturned portions 50 of each closely spaced pair define therebetween an exit of bottles, i.e., an opening 52 (see FIG. 2), which permits removal of the suspended bottles when it is desired.

Returning to FIG. 1, each shelf 12 is inserted between the side walls 18 such that the opposite side members 40 and 42 of that shelf 12 are slidably received in a pair of opposed grooves 22 at a desired elevation. The upper shelf 12 in FIG. 1 is shown in the condition where it is fully inserted whereas the lower shelf 12 in FIG. 1 is shown in the condition where it is in the process of insertion. The shelf 12 is inserted or slid in until its rear member 38 reaches the back 20. When the shelf 12 is fully inserted, the rear member 38 rest on one of the ribs 54 on the back 20, and the protrusions 32 and 34 on the side members 40 and 42 are accommodated in the second sections 28 of the respective pair of grooves 22. When each shelf 12 is fully loaded with bottles, the side members 40 and 42 of that shelf are pulled toward each other due to the load of the bottles. However, because the protrusions 32 and 34 abut the shoulders 56 (shown in FIG. 2) in the side walls 18, the side members 40 and 42 are prevented from being disengaged from the grooves 22.

Figure 5:
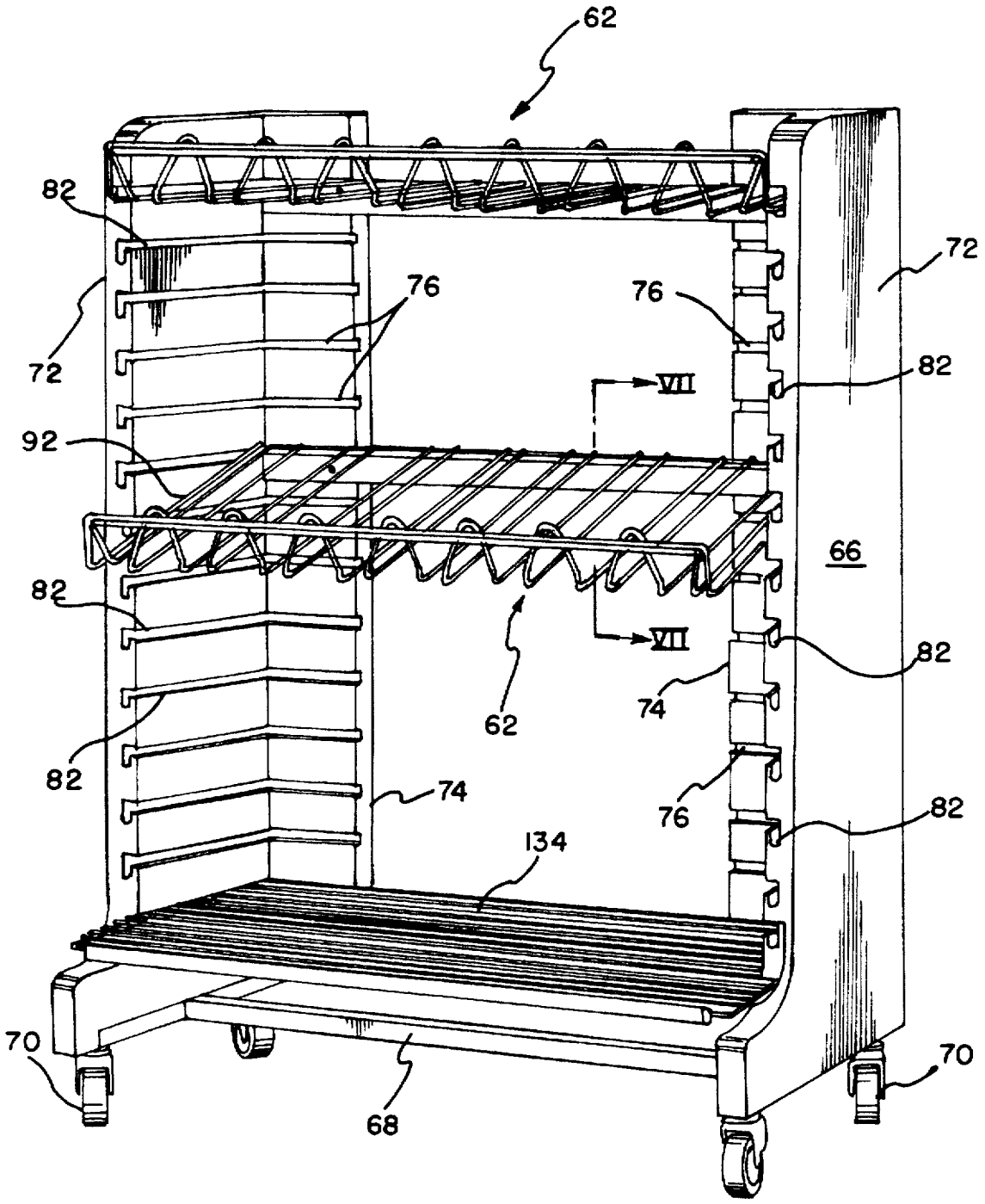
FIG. 5 is a perspective view of a display shelf device of the second embodiment according to the present invention.
Figure 6:
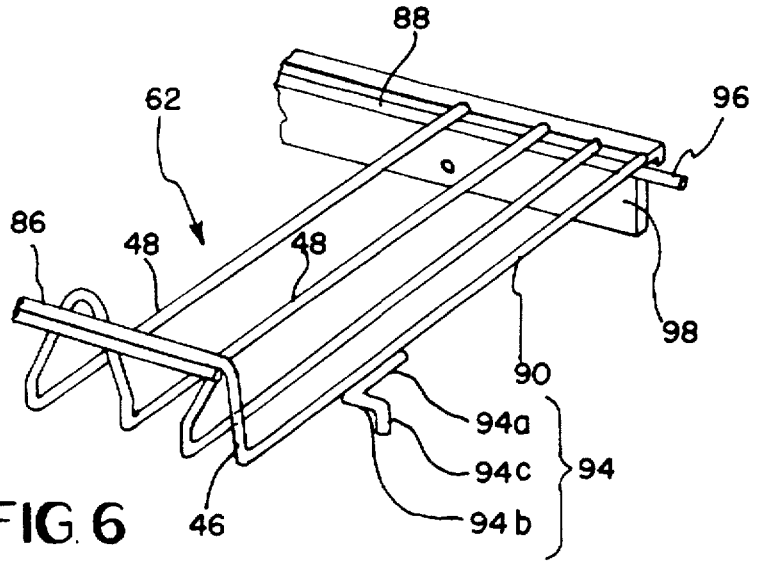
FIG. 6 is an enlarged fragmentary perspective view of one of the shelves in FIG. 5.
Figure 7:
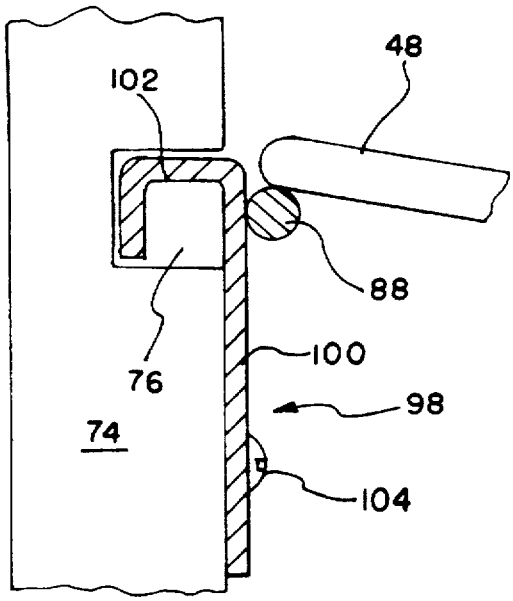
FIG. 7 is a fragmentary view taken along the line VII—VII in FIG. 5.

FIGS. 5 to 7 illustrate a second embodiment of the shelf device according to the invention. The device of this embodiment employs a pair of separate supporting structures 66 to support shelves 62 similar to the shelves 12 in the first embodiment. The supporting structures 66 are interconnected at their bottoms by a crossbar 68 and provided at their bottoms with casters 70. Each structure 66, preferably, is a unitary, hollow plastic body of a rotation- or blow-molded construction; however, it may be a solid structure formed of wood or plastic, or a hollow structure formed of sheet metal.

Each structure 66 comprises a side wall 72 and a back wall 74 joined to the rear end of the side wall 72 to form a vertically elongated body of an essentially L-shaped horizontal cross section. The side walls 72 of the structures 66 are positioned opposed to each other, and the inner upright surfaces of the side walls 72 are formed with pairs of horizontal grooves 82. The details of the grooves 82 including their design and the arrangement are virtually identical to those of the grooves 22 in the first embodiment. In this embodiment, however, the main length of each groove 82 may be designed shorter than that of the grooves 22 in the first embodiment. The preferred size of the main length of each groove 82 is less than two (2) inches. The back walls 74 are formed with a pair of collinear horizontal grooves 76 for receiving the rear edges of the shelves 62. These back wall grooves 76 are formed continuously with the grooves 82 in the respective side walls 72.

The shelves 62 are designed so that they may be used either in a horizontal position or in an inclined position wherein the shelves 62 serve as gravity feed bottle-dispensing racks. Referring to FIG. 6, the shelves 62 defer from those in the first embodiment in that the side members such as at 90 do not have the cranked portions and thus do not provide the mounting means for engagement with the side walls 72. Instead, the rear member 88 and hooks 94 provide the mounting means.

Each hook 94 is formed of cranked wire elements and comprises a base portion 94*a*, a proximal portion 94*b* and a distal portion 94*c*. The base portion 94*a* is welded to the lower surface of the respective side member. The proximal portion 94*b* extends laterally and horizontally from the respective side members. The distal portion 94*c* extends downward from the free end of the proximal portion 94*b* to serve as a locking means to be received in the second section of the respective groove 82. These hooks 94 are welded at the positions intermediate the front and rear members 86 and 88 such that they can be received in the associated grooves 82 while the front half of the respective shelf 62 is extended forward beyond the front ends of the side walls 72. This is necessary because the side members of the shelves 62 is greater in length than the grooves 82 of the side walls 72.

The rear member 88 is extended horizontally outwardly beyond the side members 90 and 92 (shown in FIG. 5) so that the opposite ends of the rear member 88 serve as the second mounting means to be received in the associated grooves 82. The rear member 88 is formed separately from the front and side members 86, 90 and 92 which may be formed from a single continuous strip of wire.

The shelves 62 further defer from the shelves 12 in that an elongate rear bracket 98 formed of sheet metal is welded along the rear member 88 of each shelf 62. As shown in FIG. 7, the rear bracket 98 has a panel body 100 and a lipped flange 102 formed along the upper edge of the panel body 100. The flange 102 extends from the rear side of the panel body 100 and is turned downwardly. The other parts of each shelf 62 are virtually identical to those of the shelf 12 in the first embodiment.

The shelves 62 may be mounted on the supporting structures 66 in the horizontal positions wherein the side members 90 and 92 and the longitudinal members 48 are disposed generally horizontally. For example, the upper shelf 62 in FIG. 5 is shown in the horizontal position. This position may be achieved by inserting the shelf 62 between the side walls 72 such that the hooks 94 on the opposite side members 90 and 92 are slidably received in a pair of opposed grooves 82 in which the opposite ends 96 of the rear member 88 are also received. The rear bracket 98 of the upper shelf 62, as shown in FIG. 7, is received at its lipped flange 102 in the grooves 76 of the back walls 74 at the same elevation as the grooves 82 in which the hooks 94 and the opposite ends 96 are received. Further, the rear bracket 98 is secured to the back walls 74 by removable fastening means 104 such as screws, push fasteners, hollow wall fasteners or the like.

Alternatively, the shelves 62 may be supported in the inclined positions wherein the side members 90 and 92 are inclined downwardly toward the upturned portions 46. For example, the lower shelf 62 in FIG. 5 is shown in the inclined position. This inclined position may be achieved by using two adjacent pairs of opposed grooves 82 to support the shelf 62. More specifically, the opposite hooks 94 of the inclined shelf 62 are received in the grooves 82 of the pair at the lower elevation than the other pair of grooves 82 in which the opposite ends 96 of the rear member 88 are received. The angle of inclination of the lower shelf 62 with respect to the horizontal may be about 1 to 20 degrees. The bottles suspended from the inclined shelf 62 are allowed to gravity feed one after another to the front end of the shelf as the leading or foremost bottles are removed successively from the shelf.

Figure 8:
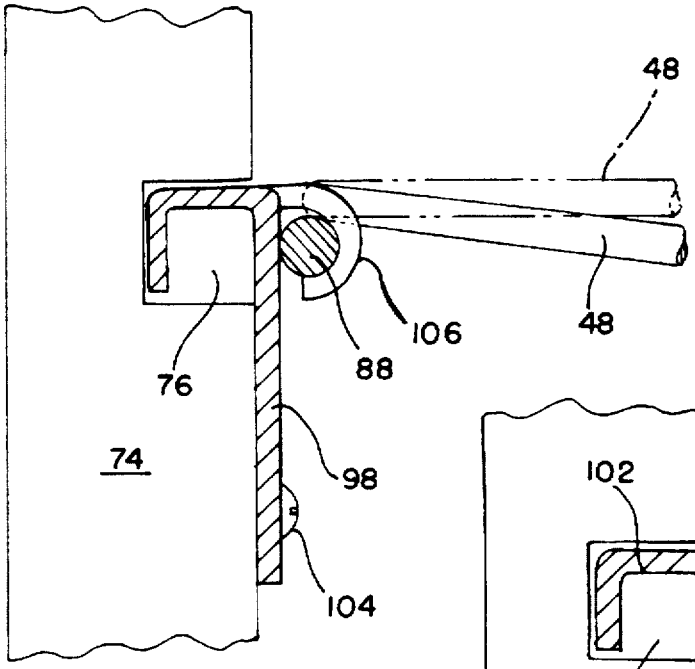
FIG. 8 is a view similar to FIG. 7, showing a modified form of the shelf in FIG. 6.

The rear bracket 98 of the lower shelf 62 is received in the grooves 76 of the back walls 74 in the same manner as that of the upper shelf 62. However, the bracket 98 of the lower shelf 62 is welded to the rear member 88 so that it defines an acute angle with the longitudinal member 48. Alternatively, as shown in FIG. 8, the rear member 88 of each shelf 62 may be pivotally held by a plurality of knuckles 106 formed on the rear bracket 98 so that the angle between the bracket 98 and the longitudinal members 48 may be adjusted to a desired angle.

Figure 9:
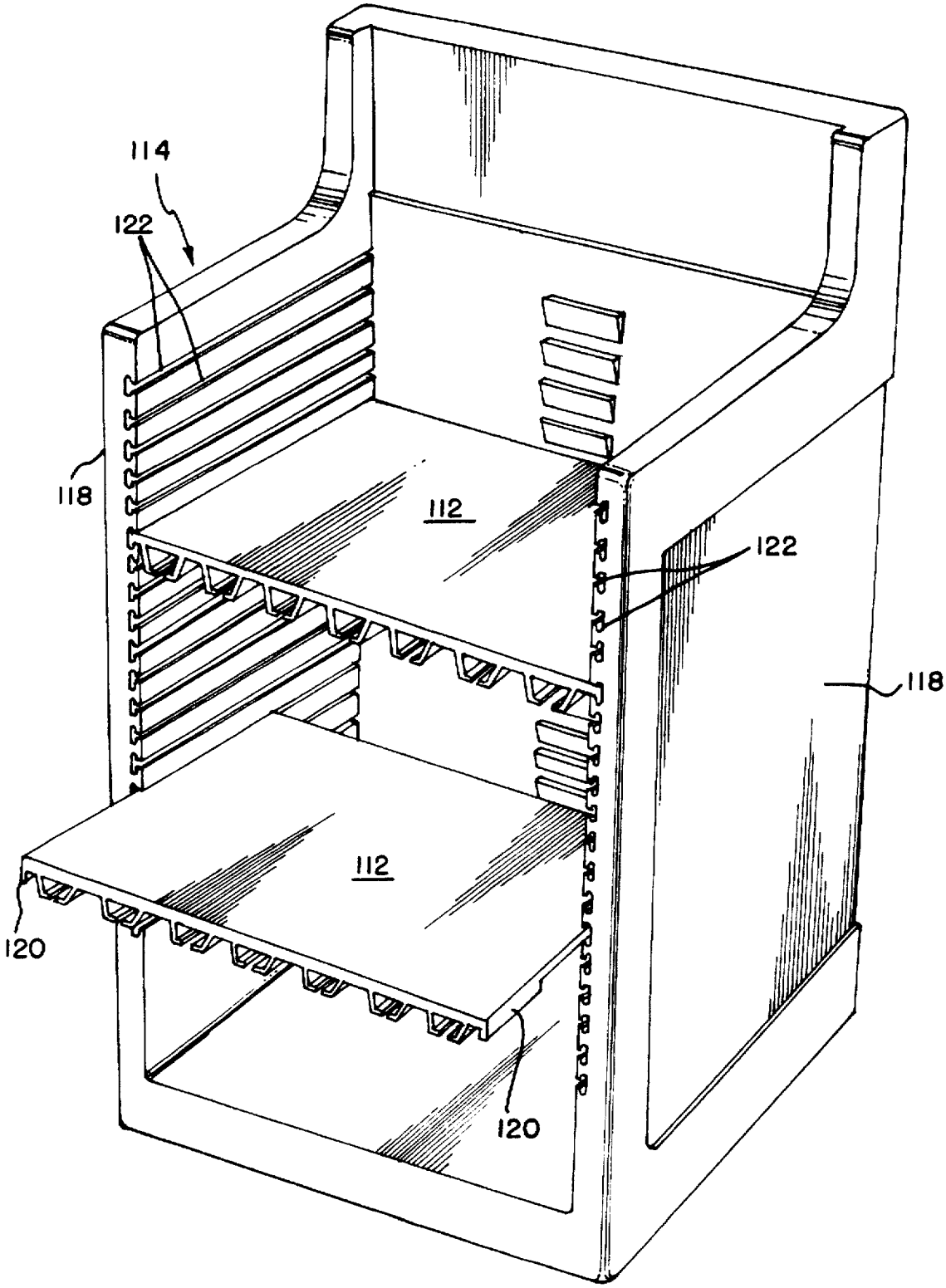
FIG. 9 is a perspective view of a display shelf device of the third embodiment according to the present invention.

FIG. 9 illustrates a third embodiment of the shelf device according to the invention. The supporting structure 114 in this embodiment differs from that in the first embodiment in that the cross section of each shelf-receiving groove 122 at the main length is T-shaped rather than L-shaped. T-shaped grooves 122 is of advantage in that the same tool may be used to form both the grooves 122 in the right side wall 118 and the grooves 112 in the left side wall 118. Otherwise, the structure 114 is virtually identical to the supporting structure 14 in the first embodiment.

The shelves 112 in this embodiment are suspension-type bottle dispensing racks of a molded structure. The general structure of each shelf 112 is described in U.S. patent application Ser. No. 08/752,867 owned by the assignee of the present invention. Each shelf 112 is provided along its opposite side edges with integral ribs 120. These ribs 120 do not extend entirely along the respective side edges of the shelf 112 but from the front edge of the shelf 112 to intermediate positions between the front and rear edges of the shelf 112. Stated differently, the side edges of each shelf 112, in this embodiment, serve as the mounting means while the ribs 120 are received in the second wider sections of the grooves 122 to serve as the locking means.

Figure 10:
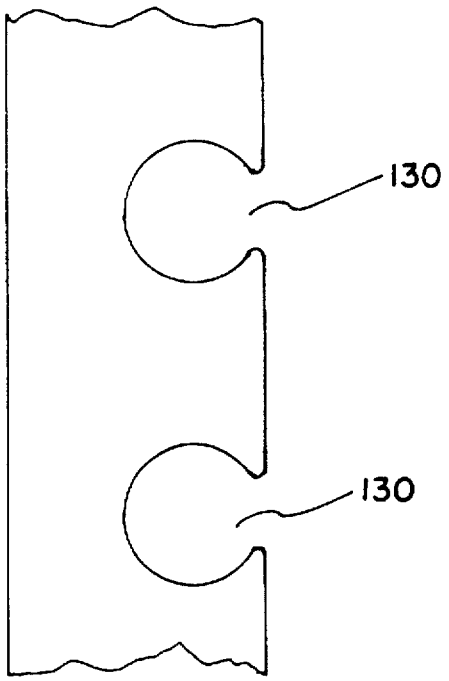
FIG. 10 is an enlarged fragmentary front view of a side wall with a modified form of the shelf-receiving grooves in FIG. 2.
Figure 11:
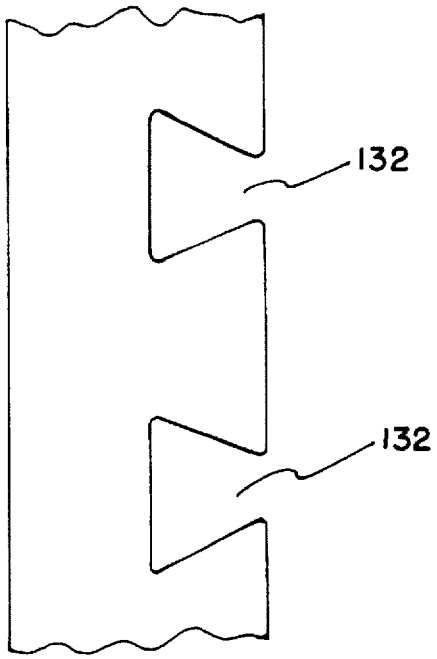
FIG. 11 is an enlarged fragmentary front view of a side wall with another modified form of the shelf-receiving grooves in FIG. 2.

It will be recognized that many variations may be made to the foregoing within the scope of the present invention. For example, the cross sections of each shelf-receiving groove at the main length may be essentially circular or wedge-shaped. An example of a circular groove is illustrated in FIG. 10 at reference numeral 130 whereas an example of a wedge-shaped groove is shown in FIG. 11 at 132. In FIGS. 1 and 9, the shelf-receiving grooves may be inclined to the horizontal. Such grooves may be inclined downwardly toward either the front or rear ends of the side walls.

It should be further recognized that the shelves used with the present invention do not necessarily be the suspension-type bottle dispensing racks but may be any regular shelves on which articles are placed. An example of a regular shelf is shown in FIG. 5 at 134. The shelf 134 is designed to support articles on its upper side and provided at its opposite edges with suitable locking means. In FIG. 5, the opposite side edges of the shelf 134 are received in the lowermost pair of grooves 82 with the locking means received in the second sections of the grooves 82.

What is claimed is:

1. A display shelf device comprising:

a pair of opposing side walls having inner upright surfaces facing each other, said upright surfaces being formed with a pair of substantially horizontal grooves respectively, each of said grooves having a first section adjacent to a respective one of said upright surfaces and a second section remote from said respective upright surface, said each groove having a vertical size greater at said second section than at said first section; and a shelf provided at opposite side edges thereof with mounting means for engagement with said side walls, said mounting means being received in said grooves such that said side walls are interconnected by said shelf, said mounting means comprising locking means received in said second sections of said grooves to lock said mounting means in said grooves, said locking means having a vertical size greater than said vertical size of said each groove at said first section whereby said side walls are secured together, wherein each of said side walls has front and rear ends defining therebetween said respective upright surface, said each groove comprising a main length including said first and second sections, said main length of said each groove extending rearward from said front end of a respective one of said side walls to an intermediate position between said front and rear ends of said respective side wall, and wherein said each groove further comprises an auxiliary length collinear and continuous with said main length of said each groove, said auxiliary length of said each groove extending rearward from said intermediate position, said each groove having at said auxiliary length a substantially constant vertical size generally equal to a vertical size of said first section at said main length.

2. A display shelf device comprising:

a pair of opposing side walls having inner upright surfaces facing each other, said upright surfaces being formed with a pair of substantially horizontal grooves respectively, each of said grooves having a first section adjacent to a respective one of said upright surfaces and a second section remote from said respective upright surface, said each groove having a vertical size greater at said second section than at said first section; and a shelf provided at opposite side edges thereof with mounting means for engagement with said side walls, said mounting means being received in said grooves such that said side walls are interconnected by said shelf, said mounting means comprising locking means received in said second sections of said grooves to lock said mounting means in said grooves, said locking means having a vertical size greater than said vertical size of said each groove at said first section whereby said side walls are secured together, wherein said side walls are two separate bodies secured together by said shelf, and wherein said device further comprises a pair of back walls connected respectively to said side walls to form a pair of shelf-supporting structures each having a L-shaped horizontal cross section, said back walls being formed with a pair of collinear horizontal grooves for receiving a rear edge of said shelf.

3. A display shelf device comprising:

a pair of opposing side walls having inner upright surfaces facing each other, said upright surfaces being formed with a pair of substantially horizontal grooves respectively, each of said grooves having a first section adjacent to a respective one of said upright surfaces and a second section remote from said respective upright surface, said each groove having a vertical size greater at said second section than at said first section; and a shelf provided at opposite side edges thereof with mounting means for engagement with said side walls, said mounting means being received in said grooves such that said side walls are interconnected by said shelf, said mounting means comprising locking means received in said second sections of said grooves to lock said mounting means in said grooves, said locking means having a vertical size greater than said vertical size of said each groove at said first section whereby said side walls are secured together, wherein said shelf is a wire shelf having a pair of side members defining said side edges of said shelf, said mounting means comprises said side members, and said locking means comprises one or more protrusions secured to each of said side members.

4. A display shelf device comprising:

a pair of opposing side walls having inner upright surfaces facing each other, said upright surfaces being formed with a pair of substantially horizontal grooves respectively, each of said grooves having a first section adjacent to a respective one of said upright surfaces and a second section remote from said respective upright surface, said each groove having a vertical size greater at said second section than at said first section; and a shelf provided at opposite side edges thereof with mounting means for engagement with said side walls, said mounting means being received in said grooves such that said side walls are interconnected by said shelf, said mounting means comprising locking means received in said second sections of said grooves to lock said mounting means in said grooves, said locking means having a vertical size greater than said vertical size of said each groove at said first section whereby said side walls are secured together, wherein said shelf is a wire shelf having a pair of side members defining said side edges of said shelf, said mounting means comprises a pair of mounting hooks secured to said side members, each of said mounting hooks comprising a first portion extending laterally from a respective one of said side members, and a second portion joined to said first portion, and said locking means comprises said second portions of said mounting hooks.

5. The device according to claim 3, wherein each of said side walls has front and rear ends defining therebetween said respective upright surface, said each groove comprising a main length including said first and second sections, said main length of said each groove extending rearward from said front end of a respective one of said side walls so that said shelf may be inserted into said grooves from said front ends of said side walls.

6. The device according to claim 2, wherein said main length of said each groove extends partially across said respective side wall to an intermediate position spaced from said rear end of said respective side wall.

7. The device according to claim 3, wherein said each groove further comprises an auxiliary length collinear and continuous with said main length of said each groove, said auxiliary length of said each groove extending from said intermediate position to said rear end of said respective side wall, said each groove having at said auxiliary length a substantially constant vertical size.

8. The device according to claim 1, wherein each of said side edges of said shelf is greater in length than said main length of said each groove.

9. The device according to claim 1, wherein said each groove has at said main length a L-shaped cross section.

10. The device according to claim 1, wherein said each groove has at said main length a T-shaped cross section.

11. The device according to claim 1, wherein said each groove has at said main length a wedge-shaped cross section.

12. The device according to claim 1, wherein said each groove has at said main length a generally circular cross section.

13. The device according to claim 1, wherein said mounting means comprises said side edges of said shelf, and said locking means comprises ribs formed along said side edges, respectively.

14. The device according to claim 1, wherein said mounting means comprises said side edges of said shelf, and said locking means comprises one or more protrusions formed along each of said side edges.

15. The device according to claim 1, wherein said mounting means comprises a pair of mounting hooks secured respectively to said side edges of said shelf, each of said mounting hooks comprising a first portion extending laterally from a respective one of said side edges, and a second portion joined to said first portion, and said locking means comprises said second portions of said mounting hooks.

16. The device according to claim 12, wherein said second portion of said each mounting hook extends generally vertically from said first portion of said each mounting hook.

17. The device according to claim 1, wherein said side walls are two separate bodies secured together by said shelf.

* * * * *